United States Patent [19]

Oppen et al.

[11] 4,264,378

[45] Apr. 28, 1981

[54] CHROMIUM-FREE SURFACE TREATMENT

[75] Inventors: Dieter Oppen, Rodgau; Karl Lampatzer, Oberursel, both of Fed. Rep. of Germany

[73] Assignee: Oxy Metal Industries Corporation, Warren, Mich.

[21] Appl. No.: 121,569

[22] Filed: Feb. 14, 1980

[30] Foreign Application Priority Data

Feb. 14, 1979 [DE] Fed. Rep. of Germany ..... 2905535

[51] Int. Cl.[3] ..... C23F 7/10; C23F 7/14

[52] U.S. Cl. ..... 148/6.15 R; 148/6.15 Z

[58] Field of Search ..... 148/6.15 R, 6.15 Z

[56] References Cited

U.S. PATENT DOCUMENTS

| | | | |
|---|---|---|---|
| 2,502,441 | 4/1950 | Dodd | 148/6.15 R |
| 2,854,369 | 9/1958 | Kronstein | 148/6.15 R |
| 2,975,082 | 3/1961 | Henricks | 148/6.15 Z |
| 3,097,118 | 7/1963 | Leonard | 148/6.15Z |
| 3,450,577 | 6/1969 | Beach | 148/6.15 R |
| 3,562,023 | 2/1971 | Courier | 148/6.15 R |
| 3,586,543 | 6/1971 | Iijima et al. | 148/6.15 R |
| 3,697,332 | 10/1972 | Kuehner | 148/6.15 Z |
| 3,819,385 | 6/1974 | Schumichen et al. | 148/6.15 Z |
| 4,110,127 | 8/1978 | Longuepee et al. | 148/6.15 Z |

FOREIGN PATENT DOCUMENTS

| | | | |
|---|---|---|---|
| 1078845 | 3/1960 | Fed. Rep. of Germany | 148/6.15 Z |
| 944419 | 12/1963 | United Kingdom | 148/6.15 Z |
| 1083779 | 9/1967 | United Kingdom | 148/6.15 R |

*Primary Examiner*—Ralph S. Kendall

*Attorney, Agent, or Firm*—Arthur E. Kluegel; Richard P. Mueller

[57] ABSTRACT

A chromium-free process for phosphatizing a metal surface provides for applying to the surface an aqueous acidic solution having pH 1.5 to 3.0 and containing phosphate; a metal cation of valence two or greater; molybdate, tungstate, vanadate, niobate or tantalate ions; and drying the solution on the surface without rinsing.

10 Claims, No Drawings

CHROMIUM-FREE SURFACE TREATMENT

BACKGROUND OF THE INVENTION

The invention relates to a process for the preparation of metal surfaces for the subsequent application of organic coatings by applying a phosphate coating by means of wetting with a phosphatizing liquid, containing at least 2-valent cations, and subsequent drying in situ of the liquid film as well as to its use for the treatment of aluminum surfaces.

The so-called three-step processes are increasingly gaining in importance for the chemical surface treatment of metals, for example as preparation for the application of paints, adhesives and plastics. In the first step, the metal surface is cleaned in order to free it from oil, dirt and corrosion products. The second step represents rinsing with water, in which residues of chemicals from the first step are removed from the metal surface. Finally, in the third step, the metal surface is wetted with an aqueous chemical reaction solution and the liquid film dried in situ.

By means of the process described above, a thin non-metallic coat is formed on the metal, which can decisively improve surface quality, with suitably selected composition of the treatment liquid and reaction condition. Thus, for example, coatings of paints, adhesives and plastics can be distinguished by materially greater adhesion and considerably increased anti-corrosive protection, if they are applied to metal pretreated in this way.

West German Examined Patent Application (Auslegeschrift) No. 17 69 582, for example, describes a process, in which an aqueous solution, containing hexavalent chromium trivalent chromium alkali ions and silicon dioxide in definite quantitative ratios, is dried on the metal in situ. The coatings formed are very suitable, for example, as electrical insulation, as anti-corrosive protection and as primer for paints and the like.

Another process is known from U.S. Pat. No. 2,030,601, in which highly concentrated aqueous solutions, containing from 10 to 20% by weight of phosphoric acid and from 10 to 15% by weight of sodium dichromate, optionally with addition of silica, are brushed on to iron surfaces and subsequently dried in situ. This treatment serves for protection against rust formation.

Furthermore, it is known to produce coatings on metal surfaces with the aid of coating agents, containing a compound of hexavalent chromium and a polymeric organic substance,—so-called primers,—and subsequently dried in situ or stoved, (Euratom Patent Specification No. 197 164).

All the above-mentioned processes have the disadvantage in common that, as a result of the presence of 6-valent chromium, special precautionary measures are required in the application of the coating agent and in the handling of the coated metal and that, when metals, coated in this manner, are used as container material for foodstuffs and beverages, influence on the content of the container cannot be excluded. If the coating agents possess organic components, a further disadvantage is the low shelf-life (pot-life) of the treatment liquids.

In order to avoid the disadvantages connected with the use of treatment liquids containing 6-valent chromium, it is already known to wet the cleaned metal surface, especially of iron, zinc and aluminum, with an acidic aqueous solution containing chromium (III) ions, phosphate ions and finely divided silica, optionally also acetate ions, maleinate ions, zinc ions and/or manganese ions, and to dry the film of solution in situ, (West German Unexamined Patent Application (Offenlegungsschrift) No. 27 11 431). Although this process possesses considerable advantages over those mentioned above, it is a shortcoming that, when the coated metals are employed as a container material, a certain influence on foodstuffs and beverages cannot be totally excluded, as a result of the chromium (III)-content of the layer, and that the treatment liquid tends towards instability through the formation of sparingly soluble chromium phosphate.

Other patents of relevance are U.S. Pat. No. 3,450,577; U.S. Pat. No. 3,819,385; U.S. Pat. No. 2,502,441; and U.S. Pat. No. 3,586,543.

It is the object of the invention to provide a process, which avoids the known, especially the above-mentioned, shortcomings and can, nevertheless, be carried out in a simple manner and without additional expense.

SUMMARY OF THE INVENTION

The problem is solved by designing the process of the type, mentioned at the beginning, according to the invention in such a way that the metal surface is wetted with a phosphatizing liquid containing at least one metal cation of valence two or greater, which possesses a pH-value of from 1.5 to 3.0, is free from chromium and, apart from metal phosphate, contains soluble molybdate, tungstate, vanadate, niobate and/or tantalate ions.

DETAILED DESCRIPTION OF THE INVENTION

The wetting of the metal surface can be effected e.g. by dipping and subsequent draining, pouring on and throwing off, brushing, spraying with compressed air, airless as well as electrostatic, atomization, or roller application with structured and smooth rollers, running in the same direction or in opposite directions to each other.

The phosphatizing liquid to be used in accordance with the process according to the invention can be modified by incorporating, in addition, simple or complex-bound fluoride ions, such as fluotitanate, fluozirconate, fluostannate, fluoborate and/or fluosilicate. In this way, increased improvement of anchoring is achieved, as a result of an appropriate mordant attack on the metal surface.

Preferably, metal phosphates are employed, in which the cationic component of the metal phosphate is formed by calcium, magnesium, barium, aluminum, zinc, cadmium, iron, nickel, cobalt and/or manganese. They form firmly adhering tertiary phosphates in a most simple manner.

It has proved to be particularly advantageous to add to the phosphatizing liquid reducing substances, especially from the group of aldehydes, oxycarboxylic acid, hydrazine, hydroxylamine and/or hypophosphite. The quantity added should be preferably at least one reduction equivalent in this case. In this connection, one reduction equivalent means the quantity of reducing agent, which is capable of lowering the valency of the molybdate, tungstate, vanadate, niobate and/or tantalate ions introduced by one valency level, i.e., for example, from Mo(VI) to Mo(V). It should be taken into account, in this connection, that individual reducing agents may possess several groups with reducing capacity within one molecule.

A further preferred embodiment of the invention consists in using phosphatizing liquids, containing, in addition, finely divided silica and/or dispersible film-forming organic polymers, such as polyacrylate. For example, silica pyrogenically produced from silicon tetrachloride or silica precipitated from alkali metal silicates in aqueous medium have proved satisfactory as a source of the finely divided silica. What is essential, in this case, is the small particle size of the silica, as it ensures a uniform, stable suspension in the aqueous acidic reaction liquid. The organic polymers used can be those customary in paint manufacture.

The addition of the above-mentioned substances particularly serves for thickening the phosphatizing liquid and thus represents one of the possibilities for the regulation of the thickness of the liquid film to be applied. Addition of organic polymers has an advantageous effect on promotion of adhesion in individual cases of application, depending on the subsequent treatment.

Further preferred embodiments of the process according to the invention consist in wetting the metal surface with a phosphatizing liquid, in which the molecular ratio of metal phosphate, calculated as $Me^{n+}(H_2PO_4)_n$, to molybdate, tungstate, niobate, tantalate and/or vanadate ion, calculated as $MoO_3$, $WO_3$, $V_2O_5$, $Nb_2O_5$ and $Ta_2O_5$, lies within the range of 1:(from 0.4 to 0.01) and/or in which the molecular ratio of metal phosphate, calculated as $Me^{n+}(H_2PO_4)_n$, to silica, calculated as $SiO_2$, to fluoride, calculated as $(Me^{n+}F_{n+2})^{2-}$, lies within the range of 1:(from 0.2 to 5.0):(from 0.04 to 2.0) and/or in which the weight ratio of metal phosphate, calculated as $Me^{n+}(H_2PO_4)_n$, to polymer lies within the range of 1:(from 0.1 to 2.0).

The liquids used in accordance with the invention preferably contain the components in such a quantity that they show an evaporation residue of from 5 to 150 g/liter. Preferably, wetting is effected with a quantity of liquid film of between 2.5 and 25 ml/m$^2$ of working part surface. Particularly good application results are achieved if the film of the phosphatizing liquid is measured in such a way that, after drying in situ, a coating weight of from 0.03 to 0.6 g/m$^2$ is obtained. The drying in situ, which follows on the wetting of the metal surface, can be effected, in principle, already at room temperature. Admittedly, better results are attained at higher temperatures, temperatures of between 50° and 100° C. being preferably chosen.

The metallic working parts can be employed in the most varied form, e.g. as moulded body, tube, rod, wire; preferably, however, as metal sheet or strip.

The process according to the invention is suitable for a multiplicity of metals and metal alloys. A special application case consists in the treatment of metal surfaces of iron, zinc or alloys of these. However, the process according to the invention is of eminent importance for the coating of surfaces of aluminum or aluminum alloys. It is useful in the last-mentioned application case to effect the generally necessary cleaning with a sulphuric acid or phosphoric acid solution, which may also contain surface-active agents, especially of the non-ionic type, and, optionally, fluoride ions, within the pH-range of from 1.0 to 2.5. In this way, a particularly clean surface, free from metal oxide, especially magnesium oxide, is obtained, which has a positive effect on the adhesion of the phosphate layer to be subsequently applied.

The most important advantages of the process according to the invention are that the coatings obtained are not toxic, possess high anti-corrosive protection and good adhesion properties and adhesion promotion properties and that the treatment liquid is stable, i.e. does not undergo change in composition by reaction or precipitation of components. Besides, the process does not show any effluent problems.

The subsequent treatment, following on the process according to the invention, particularly consists in the application of paints, adhesives or plastics, which can be effected in the manner customary for this purpose.

The invention is illustrated in detail by means of the following examples.

In all the examples, aluminum strip was wetted by means of a roller coating machine with the phosphatizing liquids, described in detail in the following. The drying temperature was 80° C. throughout. Prior to the roller coating, the aluminum strip had been cleaned in a solution, containing 5 g/liter sulphuric acid (96%)
0.5 g/liter ethoxylated alkyl phenol
0.05 g/liter hydrofluoric acid (100%), which showed a pH-value of 1.3.

The contents of active substances in the individual treatment liquids as well as the quantity of liquid in ml, applied per square meter, the evaporation residue of the treatment liquid in g/liter and the coating weight obtained in mg/m$^2$ of surface are recorded in tabular form for eight embodiment examples.

The samples, thus pre-treated, were coated with a vinyl lacquer and with an epoxy/phenolic resin paint and tested for adhesion in the bending test as well as for corrosion resistance in the pasteurizing test. In these cases, technological values were found, which, in comparison with the use of solutions based on CR(III)/-$SiO_2$, showed at least equivalent, partly even better, results for the procedure according to the invention.

| Example | 1 | 2 | 3 | 4 | 5 | 6 | 7 | 8 |
|---|---|---|---|---|---|---|---|---|
| $PO_4$ [g/l] | 30 | 20 | 40 | 40 | 20 | 20 | 20 | 10 |
| Al [g/l] | 2.7 | — | — | — | — | — | — | — |
| Zn [g/l] | — | 6.5 | — | — | 6.5 | — | 6.5 | 3.25 |
| Mg [g/l] | — | — | 2.6 | 2.6 | — | 2.6 | — | — |
| Mn [g/l] | — | — | — | 5.5 | — | — | — | — |
| Co [g/l] | — | — | — | — | — | 5.5 | — | — |
| Ni [g/l] | — | — | 5.5 | — | 5.5 | — | — | — |
| Molybdate [g/l] | — | — | 5.0 | — | — | 2.5 | — | 0.5 |
| Tungstate [g/l] | 3.3 | — | — | 0.5 | — | — | — | — |
| Vanadate [g/l] | — | 1.06 | — | — | 5.3 | — | 0.5 | — |
| Fluoride, type | — | $H_2TiF_6$ | $HBF_4$ | $H_2ZrF_6$ | $H_2SiF_6$ | $H_2TiF_6$ | $HBF_4$ | $HBF_4$ |
| and quantity [g/l] | — | 1.6 | 8.8 | 2.4 | 14.4 | 16.4 | 10.4 5.2 | |
| Reducing Agent, type | Glucose | Ascorbic Acid | Hydrazine | Sodium Hypophosphite | Glucose | Hydroxylamine | Acetaldehyde | Acetaldehyde |
| and quantity [g/l] | 5.0 | 5.0 | 1.0 | 3.0 | 5.3 | 2.5 | 6.0 | 6.0 |

-continued

| Example | 1 | 2 | 3 | 4 | 5 | 6 | 7 | 8 |
|---|---|---|---|---|---|---|---|---|
| $SiO_2$ [g/l] | 6.0 | 1.2 | — | 2.4 | 12.0 | 3.0 | 12.0 | 6.0 |
| Polyacrylate [g/l] | — | — | — | — | — | — | 10.6 | 10.6 |
| Liquid Quantity [ml/m$^2$] | 8.0 | 4.0 | 8.0 | 2.0 | 8.0 | 8.0 | 8.0 | 8.0 |
| Evaporation Residue [g/l] | 44.5 | 31.0 | 61.0 | 56.0 | 66.0s | 50.0 | 60.0 | 36.0 |
| Coating Weight [mg/m$^2$] | 356 | 124 | 488 | 112 | 528 | 400 | 480 | 288 |

What is claimed is:

1. A process for the preparation of metal surfaces of iron, zinc, or aluminum or their alloys for the subsequent application of organic coatings by applying a phosphate coating by means of wetting with a phosphatizing liquid, containing at least one metal cation of valence two or greater, and subsequent drying in situ of the liquid film, characterized in that the metal surface is wetted with a phosphatizing liquid, which possesses a pH-value of from 1.5 to 3.0, is free from chromium and, apart from metal phosphate, contains at least one ion selected from the group consisting of soluble molybdate, tungstate, vanadate, niobate and tantalate ions wherein the molecular ratio of metal phosphate, calculated as $Me^{n+}(H_2PO_4)_n$, wherein n is an integer of two or more, to molybdate, tungstate, vanadate, niobate and/or tantalate ion, calculated as $MoO_3$, $WO_3$, $V_2O_5$, $Nb_2O_5$ and $Ta_2O_5$, lies within the range of 1:0.4 to 0.01.

2. The process of claim 1, characterized in that the phosphatizing liquid additionally contains simple or complex-bound fluoride ions wherein the molecular ratio of metal phosphate, calculated as $Me^{n+}(H_2PO_4)_n$, wherein n is an integer of two or more, to fluoride, calculated as $(Me^{n+}F_{n+2})^{2-}$, wherein n is an integer, lies within the range of 1:0.04 to 2.0.

3. The process of claim 2, characterized in that the phosphatizing liquid additionally contains finely divided silica wherein the molecular ratio of metal phosphate, calculated as $Me^{n+}(H_2PO_4)_n$, wherein n is an integer of two or more, to silica, calculated as $SiO_2$, to fluoride, calculated as $Me^{n+}F_{n+2})^{2-}$, wherein n is an integer, lies within the range of 1:0.2 to 5.0:0.04 to 2.0.

4. The process of claim 1, characterized in that the metal cation of valence two or greater is selected from the group consisting of calcium, magnesium, barium, aluminum, zinc, cadmium, iron, nickel, cobalt and manganese.

5. The process of claim 1, characterized in that the phosphatizing liquid additionally contains at least one reduction equivalent of a reducing substance.

6. The process of claim 1, characterized in that the phosphatizing liquid additionally contains a dispersible film-forming organic polymer wherein the weight ratio of metal phosphate, calculated as $Me^{n+}(H_2PO_4)_n$ to polymer lies within the range of 1:0.1 to 2.0.

7. The process of claim 1, characterized in that the film of the phosphatizing liquid is applied in an amount such that, after drying in situ, a coating weight of from 0.03 to 0.6 g/m$^2$ is obtained.

8. The process of claim 1, characterized in that the drying in situ of the liquid film is effected at temperatures of between 50° and 100° C.

9. The process of claim 1, wherein the metal treated is aluminum.

10. The process of claim 9, wherein the aluminum surface is cleaned with an acidic aqueous solution prior to phosphatizing.

* * * * *